US005342183A

United States Patent [19]

Rafalovich et al.

[11] Patent Number: 5,342,183

[45] Date of Patent: Aug. 30, 1994

[54] SCROLL COMPRESSOR WITH DISCHARGE DIFFUSER

[75] Inventors: Alexander P. Rafalovich, Dayton; Mark Bass, Sidney; Jean-Luc Caillat, Dayton, all of Ohio

[73] Assignee: Copeland Corporation, Sidney, Ohio

[21] Appl. No.: 912,897

[22] Filed: Jul. 13, 1992

[51] Int. Cl.[5] ..... F04C 18/04

[52] U.S. Cl. ..... 418/15; 418/55.1; 418/55.2

[58] Field of Search ..... 418/15, 55.1, 55.2

[56] References Cited

U.S. PATENT DOCUMENTS

| | | | |
|---|---|---|---|
| 4,082,484 | 4/1978 | McCullough | 418/55.2 |
| 4,469,126 | 9/1984 | Simpson | 417/569 |
| 4,494,914 | 1/1985 | Shiibayashi | 418/55.2 |
| 4,767,293 | 8/1988 | Caillat et al. | 418/55.5 |

FOREIGN PATENT DOCUMENTS

| | | | |
|---|---|---|---|
| 59-34494 | 2/1984 | Japan | 418/55.2 |
| 60-1396 | 1/1985 | Japan | 418/15 |
| 61-197782 | 9/1986 | Japan | 418/55.2 |
| 63-1792 | 1/1988 | Japan | 418/55.1 |
| 63-223379 | 9/1988 | Japan | 418/55.2 |
| 1-106987 | 4/1989 | Japan | 418/15 |

OTHER PUBLICATIONS

Fox and McDonald, *Introduction to Fluid Mechanics*, 3d Ed., 222, 368–69, 382–84, 596–99, 611–17, New York (1985).

*Primary Examiner*—John J. Vrablik

*Attorney, Agent, or Firm*—Harness, Dickey & Pierce

[57] ABSTRACT

A scroll-type compressor is disclosed having a discharge diffuser for improving the efficiency of the compressor, especially at off-design, high pressure ratio operating conditions. The diffuser allows fluid pressure recovery and consequently results in an efficient discharge process using a relatively small discharge port. It also reduces compression losses by reducing gas transport in the reverse flow direction.

20 Claims, 3 Drawing Sheets

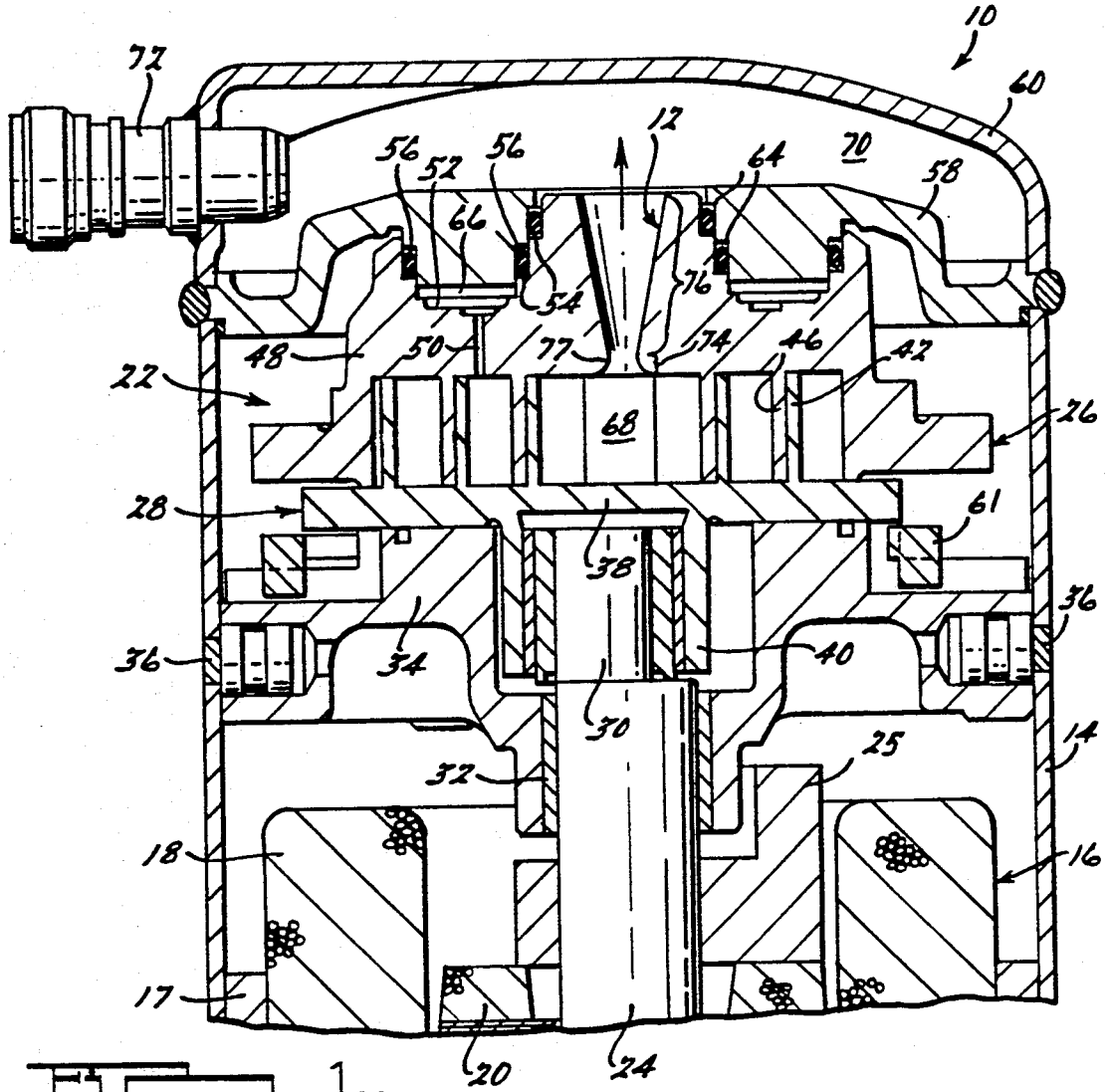
FIG. 1.
FIG. 2.
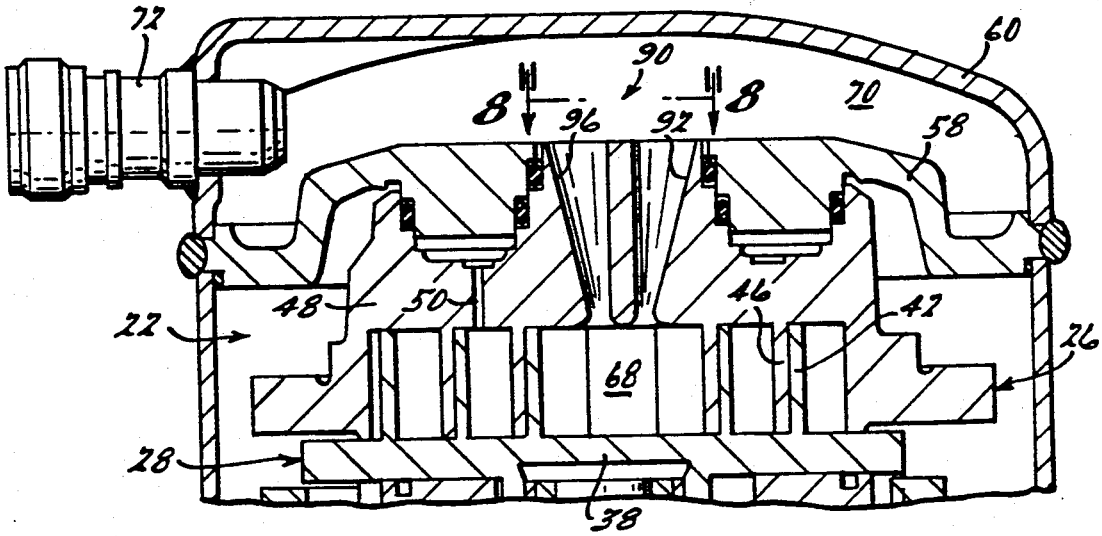

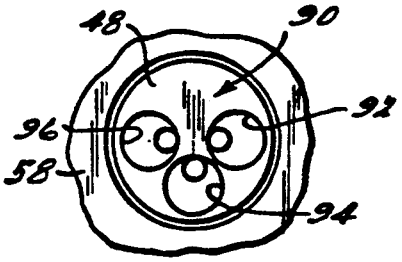
FIG. 8.
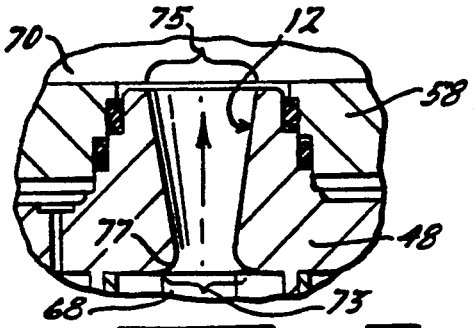
FIG. 7.
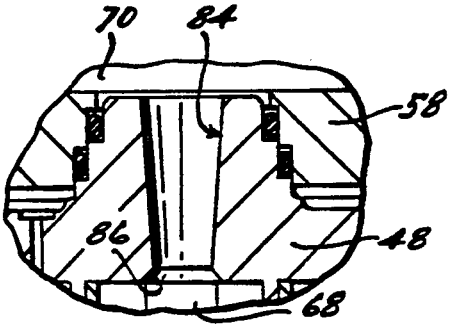
FIG. 6.
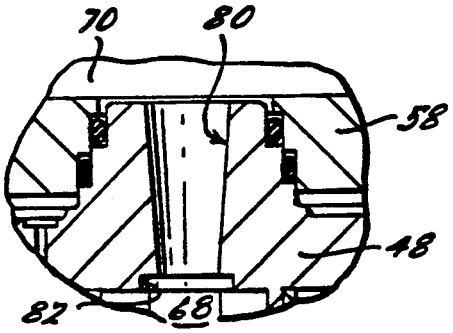
FIG. 5.
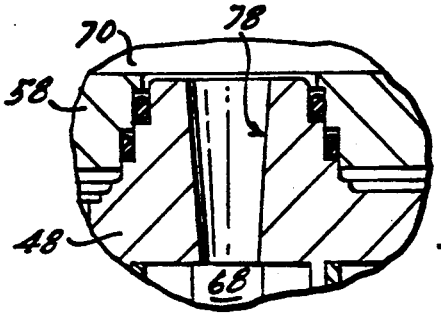
FIG. 4.
FIG. 3.
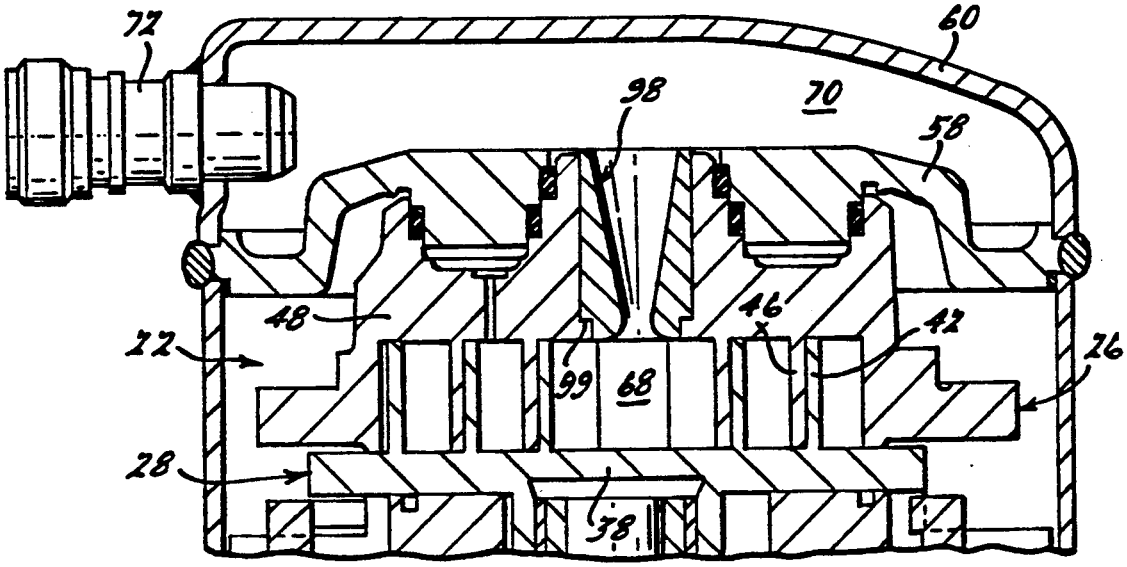

SCROLL COMPRESSOR WITH DISCHARGE DIFFUSER

BACKGROUND AND SUMMARY OF THE INVENTION

Scroll compressors are widely used for refrigeration and air conditioning systems. They are generally constructed of two scroll members, each having an end plate and a spiral wrap. The scroll members are arranged in an opposing manner with the spiral wraps interfitted, and the scroll members are mounted so that one scroll member moves orbitally with respect to the other scroll member. During this orbiting movement, the spiral wraps define moving fluid pockets which decrease in size as they progress radially inwardly from an outer position at relatively low suction pressure to a central position at relatively high discharge pressure.

The compressed fluid generally exits from a central discharge chamber through a port formed through the end plate of one of the scroll members. This port is usually simply a hole having straight walls formed through the end plate. Because the end plate is relatively thin, as compared to the height of spiral wraps and the size of the central discharge pressure chamber, it has been discovered that the discharge port often acts as a choke plate or throttle to restrict discharge flow. This restriction reduces the efficiency of the scroll compressor.

In addition, the compression ratio of a scroll compressor in operation may fluctuate for a variety of operational reasons, even though the scrolls have a theoretically constant built-in volume ratio. This fluctuation results in over-compression losses or reverse flow and re-compression losses. Also, reverse flow can cause undesirable reverse rotation when the machine is shut down. One method to reduce reverse flow and re-compression losses is the use of a dynamic, one-way valve in the discharge port. Such valves, however, are often noisy, unreliable, and reduce compressor efficiency due to valve losses in normal operation. They also add additional cost for valve and auxiliary hardware, as well as assembly.

The present invention has as its object the obviation of the problems associated with the current art by providing a uniquely configured discharge passage which provides a highly efficient diffuser effect. The diffuser is formed either having a converging portion and a diverging portion, or a diverging portion only, and may be constructed with or without a tail pipe. The diffuser provides efficient flow through enhanced pressure recovery from the central discharge pressure chamber while resisting reverse flow.

The various advantages and features will become apparent from the following descriptions and claims in conjunction with the accompanying drawings:

BRIEF DESCRIPTION OF THE DRAWINGS

FIG. 1 is a partial vertical sectional view generally through the center of a scroll compressor embodying the principles of the present invention;

FIG. 2 is a fragmentary view similar to FIG. 1, but illustrating another embodiment of the present invention;

FIG. 3 is a view similar to that of FIG. 2 showing an additional embodiment;

FIGS. 4–7 are fragmentary vertical sectional views illustrating yet additional embodiments;

FIG. 8 is a top plan view taken generally along line 8—8 in FIG. 2;

DETAILED DESCRIPTION OF THE PREFERRED EMBODIMENT

Figure 9:
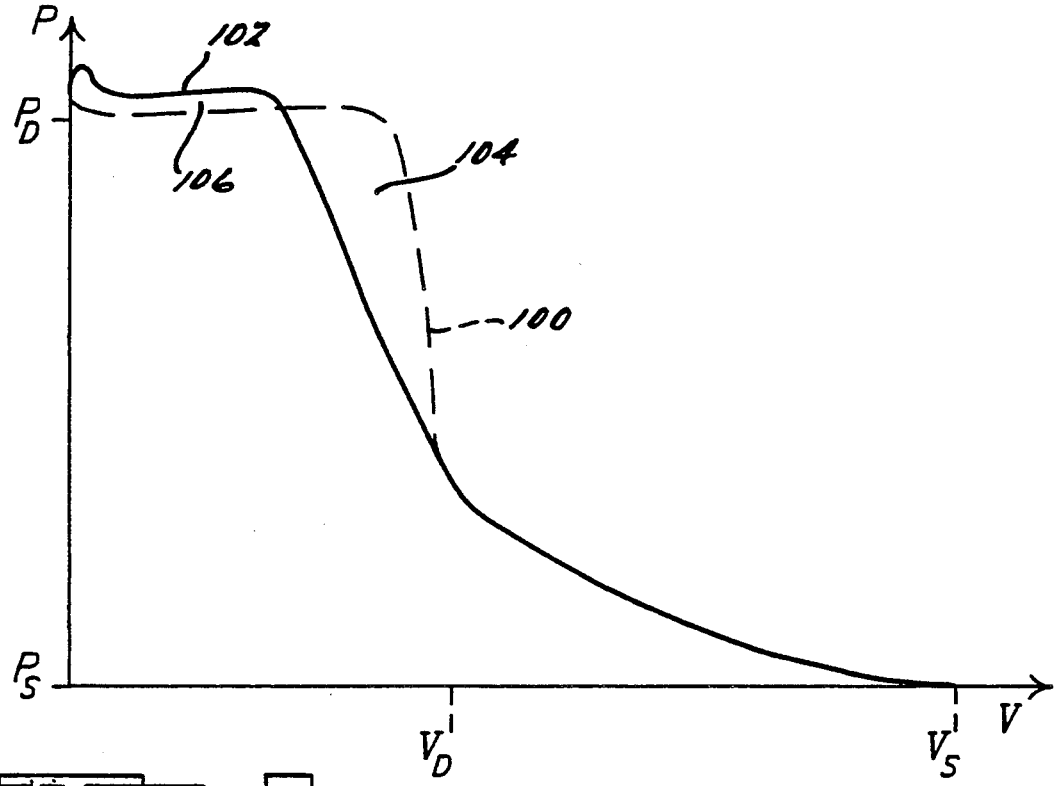
FIG. 9 is an indicator diagram showing pressure with respect to volume for a conventional compressor as compared to a compressor embodying the principles of the present invention.

The following description of the preferred embodiment is merely exemplary in nature and is in no way intended to limit the invention or its application or uses.

Referring now to the drawings, and more specifically to FIG. 1, there is shown a hermetic refrigeration scroll compressor 10 incorporating the unique discharge diffuser 12 according to the present invention.

Compressor 10 is constructed of a hermetic shell 14 within the lower portion of which is disposed an electric motor 16 including a stator 17, windings 18 and a rotor 20. Motor 16 drives a compressor assembly 22 disposed in the upper portion of shell 14 by a drive shaft 24 extending between the compressor assembly 22 and rotor 20, to which drive shaft 24 is secured. Compressor assembly 22 is of the scroll type and incorporates an upper non-orbiting scroll member 26 and a lower orbiting scroll member 28 which is driven by a crank pin 30 on drive shaft 24 in an orbiting motion relative to non-orbiting scroll member 26. Drive shaft 24 is affixed to a counterweight 25 and is rotatably supported within shell 14 by means of main bearing assembly 32 and optionally a lower bearing assembly (not shown). Main bearing assembly 32 is fixedly secured to shell 14 by means of main bearing housing 34 and plug welds 36.

Orbiting scroll member 28 is formed having an end plate 38, an axial boss 40, and a spiral wrap 42. Non-orbiting scroll member 26 has a similar spiral wrap 46, an end plate 48 which is formed with at least one bleed hole 50, an annular intermediate backpressure cavity 52, and a series of steps 54 which allow room for elastomeric seals 56, as well as the unique discharge diffuser 12 of the present invention.

Non-orbiting scroll member 26 is supported and held in position in any of a variety of ways. Mounting configurations are described in U.S. Pat. No. 4,767,293 to Caillat et al., which issued on Aug. 30, 1988, filed on Aug. 22, 1986, entitled "Scroll Type Machine With Axially Compliant Mounting", which is assigned to the same assignee as the present application; the disclosure of which is hereby incorporated herein by reference. Additional mounting arrangements are shown in U.S. Pat. No. 5,102,316 to Caillat, et al., which issued on Apr. 7, 1992, filed on Oct. 1, 1990, entitled "Non-Orbiting Scroll Mounting Arrangements for a Scroll Machine", which is also assigned to the same assignee as the present application; the disclosure of which is hereby incorporated herein by reference.

A muffler plate 58 is welded to shell 14 along with a muffler cap 60 to define a muffler chamber 70. Muffler plate 58 is formed with a series of steps 64 which are similar and opposite to steps 54, which cooperate to engage seals 56. Bleed hole 50 allows fluid communication between an intermediate pressure fluid pocket defined by orbiting and non-orbiting scroll members 28 and 26, and an intermediate backpressure chamber 66.

Backpressure chamber 66 defined between scroll member 26 and muffler plate 58 operates to bias non-orbiting scroll member 26 axially towards orbiting scroll member 28 to enhance sealing contact between the tips of spiral wraps 42 and 46 and end plates 48 and 38, respectively. This construction thus provides an axially compliant mounting arrangement for non-orbiting scroll member 26.

In operation, motor 16 rotates drive shaft 24 which drives orbiting scroll member 28 in orbiting motion with respect to non-orbiting scroll member 26. The usual Oldham coupling 61 prevents scroll member 28 from rotating about its own axis. Orbiting and non-orbiting spiral wraps 42 and 46 define moving fluid pockets which progress from a radially outer position at relatively low suction pressure to a radially inner position or discharge pressure chamber 68 at relatively high discharge pressure. The compressed fluid within discharge pressure chamber 68 exits through the discharge diffuser 12 of the present invention, into muffling chamber 70, and through a one-way discharge valve 72 to the usual refrigerant circuit.

The novel scroll discharge diffuser 12 of the present invention may be used to improve the discharge flow and operating efficiency of the scroll machine which has been described thus far. Discharge diffuser 12 has been discovered to provide a more efficient flow passage for the pressurized refrigerant gas. Diffuser 12 has an entrance port 73, a converging portion 74, a diverging portion 76, a throat 77 therebetween, and an exit port 75. In the forward flow direction as indicated by the arrow in FIGS. 1 and 7, converging portion 74 is arranged before diverging portion 76.

The ideal diffuser 12, in its simplest form, has a shape which features a smooth, rounded, converging inlet portion 74 and a smooth transition at the throat to a diverging portion 76 having straight walls, as shown in FIG. 7. The cross-sectional area of the passage should progressively decrease throughout converging portion 74 and progressively increase throughout diverging portion 76 in the forward flow direction. Converging portion 74 preferably has an axial length which is much less than the axial length of diverging portion 76, as is shown in FIG. 7.

The diffuser of the present invention may be constructed in a variety of alternative configurations. For example, diffuser 78 may be constructed as a pure diffuser only, having no converging portion 74, as is shown in FIG. 4. Alternatively, the diffuser of the present invention may be constructed having a converging portion manufactured as a simple chamfered inlet 86, as is shown in FIG. 6, or may be manufactured having the configuration 80 shown in FIG. 5 which has a stepped counterbore inlet 82.

Figure 10:
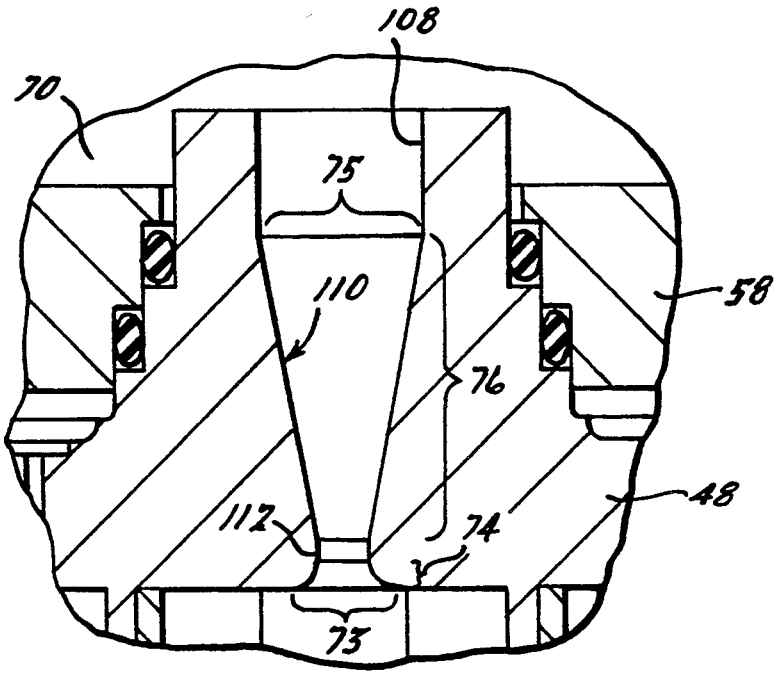
FIG. 10 is a view similar to those of FIGS. 4–7 depicting a further additional embodiment.

Exit port 75 of diffuser 12 will usually communicate with an expansion or muffler chamber 70. An additional alternative embodiment of the present invention is depicted in FIG. 10 and includes a tail pipe 108 formed at exit port 75 of diffuser 110. Tail pipe 108 should preferably have a length which equals at least one-half of the diameter of exit port 75. As is shown in FIG. 10, diffuser 110 may be formed in any of its various configurations with a relatively short throat portion 112 having straight walls, even though the smoothly curved throat 77 shown in FIGS. 1 and 7 are preferred.

Regardless of the particular configuration of the diffuser, the cross-sectional shape of diffuser 12 is preferably circular. Moreover, the included angle of diverging portion 76 is preferably in the range of 5 to 20 degrees, and ideally is approximately 7 to 15 degrees, depending on its length. The length of the diffuser should be as short as possible with respect to the diameter of exit port 75 without increasing pressure losses and choking the discharge flow.

The diffuser of the present invention restricts reverse flow because the flow will tend to choke in the reverse direction. The diffuser, however, provides for minimum forward pressure losses, while it increases the efficiency and reliability of the compressor, especially at relatively high pressure ratios. Furthermore, the diffuser enables a scroll compressor to have a higher built-in compression ratio for an assembly having the same diameter, because of the smaller cross-sectional area of entrance port 73.

A further alternative embodiment of the present invention is shown in FIGS. 2 and 8, which depict a discharge diffuser 90 having a plurality of flow passages 92, 94, 96, each of which is formed in a similar manner as the passage of diffuser 12. Discharge passages 92, 94, 96 are arranged so that each passage opens in a sequential manner and communicates with discharge pressure chamber 68 in sequence as orbiting scroll member 28 orbits with respect to non-orbiting scroll member 26. Closing occurs in a similar sequential manner. An efficiency increase also arises from employing multiple ports because it is possible to use a greater exit area for the same angle, length and throat area, and thereby to further reduce discharge velocity. Furthermore, the multi-channel diffuser 90 enables the use of a diffuser having a preferably shorter axial length (i.e. through a thinner end plate) with respect to the diameter of exit port 75, to provide the same cross-sectional area ratio between throat 77 and exit port 75, without sacrificing performance.

Yet another alternative embodiment is shown in FIG. 3, wherein diffuser 98 is constructed as a separate tubular member which is simply inserted in non-orbiting scroll member 26. As a result, diffuser 98 may be precision manufactured separately and installed during assembly. Preferably, a shoulder 99 is provided to accurately locate diffuser 98 with respect to scroll member 26. Diffuser 98 can be press fit in place, or can be welded or screwed or even bolted to non-orbiting scroll member 26.

The improvement in efficiency of compressor operation provided by the diffuser of the present invention is illustrated in FIG. 9, which is an indicator diagram, depicting pressure with respect to volume for a compressor having a conventional discharge port and for a compressor utilizing the diffuser of the present invention, shown as lines 100 and 102 respectively. FIG. 9 further shows the energy gain, represented by area 104, and the energy loss, represented by area 106, resulting from use of the diffuser of the present invention. As can be seen, the diffuser of the present invention clearly results in a net efficiency gain because energy gain 104 is greater than energy loss 106. This efficiency gain has been found to be as much as 11% at high compression ratios, with an average efficiency gain of 7%.

It should be understood that the preferred embodiment of the present invention have been shown and described herein, and that various modifications of the preferred embodiment will become apparent to those skilled in the art after a study of the specification, drawings, and following claims.

We claim:

1. A scroll-type compressor comprising:

a first scroll member having a first spiral wrap thereon;

a second scroll member having a second spiral wrap thereon, said first and second scroll members being mounted for orbiting movement with respect to one another, said first and second wraps being mounted in opposing and interfitting relationship, whereby said orbiting movement will cause said first and second wraps to define at least one fluid pocket moving from a radially outer position at suction pressure to a radially inner position in a discharge pressure chamber at discharge pressure; and more than one discharge passage for communicating with said discharge pressure chamber, said passages each having an inner surface defining a converging entrance portion with a cross-section which progressively decreases in a forward flow direction, and a diverging exit portion with a cross-section which progressively increases in said flow direction, whereby said discharge passages reduce discharge pressure losses of a working fluid flowing through said passage without causing significant separation of said working fluid from said inner surface.

2. The compressor as set forth in claim 1, wherein said converging portions and said diverging portions define a converging length and a diverging length respectively, said converging length being less than said diverging length.

3. The compressor as set forth in claim 1, wherein each of said discharge passages communicates with said discharge pressure chamber in sequence as said scroll members orbit with respect to said one another.

4. The compressor as set forth in claim 1, wherein the entrance to said converging portions are smoothly radiused to reduce turbulence of the flow thereinto.

5. The compressor as set forth in claim 1, wherein the exit portions of said passages communicate with an expansion chamber.

6. The compressor as set forth in claim 1, wherein said discharge passages are formed as a tubular member adapted to be affixed to one of said scroll members.

7. In a scroll-type compressor having a first scroll member with a first spiral wrap thereon, a second scroll member with a second spiral wrap thereon, said first and second scroll members being mounted for relative orbiting movement with respect to each other, said first and second wraps being mounted in intermeshed relationship, said first scroll member being mounted for axial compliance with respect to said second scroll member, whereby said orbiting movement will cause said first and second wraps to define at least one fluid pocket moving from a radially outer position at suction pressure to a radially inner position in a discharge pressure chamber at discharge pressure, a discharge diffuser comprising:

more than one passage for communicating with said discharge pressure chamber, said passages each having an inner surface which is symmetrical about an axis, said inner surface defining a converging entrance portion with a cross-section which progressively decreases in a forward flow direction, and a diverging exit portion with a cross-section which progressively increases in said flow direction, a portion of said exit portion having a frustoconical shape.

8. The discharge diffuser as set forth in claim 7, wherein each of said passages communicates with said discharge pressure chamber in sequence as said second scroll member orbits with respect to said first scroll member.

9. A discharge diffuser for use in a scroll-type compressor having a first scroll member with a first spiral wrap thereon, a second scroll member with a second spiral wrap thereon, said first and second scroll members being mounted for orbiting movement with respect to one another said first and second wraps being mounted in opposing and interfitting relationship, whereby said orbiting movement will cause said first and second wraps to define at least one fluid pocket moving from a radially outer position at suction pressure to a radially inner position in a discharge pressure chamber at discharge pressure, said discharge diffuser comprising:

a tubular member defining more than one passage for communicating with said discharge pressure chamber, said passages each having an inner surface which is symmetrical about an axis, said inner surfaces each defining a converging entrance portion with a cross-section which progressively decreases in a forward flow direction, and a diverging exit portion with a cross-section which progressively increases in said flow direction, said tubular member adapted to be affixed to said first scroll member for reducing discharge pressure losses of a working fluid flowing through said passage, wherein each of said passages communicates with said discharge pressure chamber in sequence as said second scroll member orbits with respect to said first scroll member.

10. A scroll-type compressor comprising:

a first scroll member having a first spiral wrap thereon;

a second scroll member having a second spiral wrap thereon, said first and second scroll members being mounted for orbiting movement with respect to one another, said first and second wraps being mounted in opposing and interfitting relationship whereby said orbiting movement will cause said first and second wraps to define at least one fluid pocket moving from a radially outer position at suction pressure to a radially inner position in a discharge pressure chamber at discharge pressure; and a discharge passage communicating with said discharge pressure chamber, said passage having a converging entrance portion with a cross-section which progressively decreases in a forward flow direction, a diverging exit portion with a cross-section which progressively increases in said flow direction, and a tail pipe having a substantially constant cross-section which communicates with said diverging exit portion, whereby discharge pressure losses are minimized.

11. The compressor as set forth in claim 10, wherein said discharge passage is formed as a tubular member adapted to be affixed to said first scroll member.

12. The compressor as set forth in claim 10, further comprising one or more additional diverging discharge passages each being formed similar to said discharge passage.

13. The compressor as set forth in claim 12, wherein each of said discharge passages communicates with said discharge pressure chamber in sequence as said second scroll member orbits with respect to said first scroll member.

14. A scroll-type compressor comprising:

a first scroll member having a first spiral wrap thereon;

a second scroll member having a second spiral wrap thereon, said first and second scroll members being mounted for orbiting movement with respect to each other, said first and second wraps being mounted in opposing and interfitting relationship, whereby said orbiting movement will cause said first and second wraps to define at least one fluid pocket moving from a radially outer position at suction pressure to a radially inner position in a discharge pressure chamber at discharge pressure; and a diverging discharge diffuser for communicating with said discharge pressure chamber, said diffuser having a diverging passage with a cross-section which progressively increases in a forward flow direction, said passage diverging at an included angle substantially within the range of 5 degrees to 20 degrees and defining an exit perimeter, said diffuser having a tail pipe with a substantially constant cross-section having an entry perimeter which communicates with, and substantially matches, said exit perimeter of said diverging passage, wherein an exit of said tail pipe communicates with an expansion chamber, whereby discharge pressure losses are reduced.

15. The discharge diffuser as set forth in claim 14, further comprising one or more additional passages each being formed similar to said discharge passage.

16. The discharge diffuser as set forth in claim 15, wherein each of said passages communicates with said discharge pressure chamber in sequence as said second scroll member orbits with respect to said first scroll member.

17. A scroll-type compressor comprising:

a first scroll member having a first spiral wrap thereon;

a second scroll member having a second spiral wrap thereon, said first and second scroll members being mounted for orbiting movement with respect to each other, said first and second wraps being mounted in opposing and interfitting relationship, whereby said orbiting movement will cause said first and second wraps to define at least one fluid pocket moving from a radially outer position at suction pressure to a radially inner position in a discharge pressure chamber at discharge pressure;

a discharge passage communicating with said discharge pressure chamber, said passage having an inner surface defining a converging entrance portion with a cross-section which progressively decreases in a forward flow direction, and a diverging exit portion with a cross-section which progressively increases in said flow direction, whereby said discharge passage reduces discharge pressure losses of a working fluid flowing through said passage; and an intermediate portion disposed between said entrance portion and said exit portion, said intermediate portion having a constant cross-section.

18. The discharge diffuser as set forth in claim 17, wherein said converging and diverging portions define a converging length and a diverging length respectively, said converging length being less than said diverging length.

19. The discharge diffuser as set forth in claim 17, further comprising one or more additional passages each being formed similar to said passage.

20. The discharge diffuser as set forth in claim 19, wherein each of said discharge passages communicates with said discharge pressure chamber in sequence as said second scroll member orbits with respect to said first scroll member.

* * * * *